US007695576B2

(12) United States Patent
Ozaki

(10) Patent No.: US 7,695,576 B2
(45) **Date of Patent: *Apr. 13, 2010**

(54) LOW ALLOY HIGH STEEL TOOL HAVING CONSTANT TOUGHNESS

(75) Inventor: Kozo Ozaki, Nagoya (JP)

(73) Assignee: Daido Steel Co., Ltd., Aichi (JP)

( * ) Notice: Subject to any disclaimer, the term of this patent is extended or adjusted under 35 U.S.C. 154(b) by 596 days.

This patent is subject to a terminal disclaimer.

(21) Appl. No.: 11/402,878

(22) Filed: Apr. 13, 2006

(65) Prior Publication Data

US 2006/0180249 A1 Aug. 17, 2006

Related U.S. Application Data

(63) Continuation-in-part of application No. 10/806,440, filed on Mar. 23, 2004, now abandoned.

(30) Foreign Application Priority Data

Mar. 24, 2003 (JP) ..... 2003-081010

(51) Int. Cl.
*C22C 38/24* (2006.01)

(52) U.S. Cl. ..... 148/334; 148/335; 420/105; 420/106; 420/107; 420/108; 420/109; 420/111

(58) Field of Classification Search ..... 148/334, 148/335; 420/105–109, 111
See application file for complete search history.

(56) References Cited

U.S. PATENT DOCUMENTS

| | | | | |
|---|---|---|---|---|
| 5,458,703 | A | 10/1995 | Nakai | |
| 6,024,916 | A | 2/2000 | Urita et al. | |
| 7,494,618 | B2 * | 2/2009 | Ozaki | 420/109 |

FOREIGN PATENT DOCUMENTS

| | | |
|---|---|---|
| JP | 50-10808 | 4/1975 |
| JP | 61-213349 | 9/1986 |
| JP | 04-346616 | 12/1992 |
| JP | 07-316739 | 12/1995 |
| JP | 11-1311973 | 5/1999 |

* cited by examiner

*Primary Examiner*—Sikyin Ip
(74) *Attorney, Agent, or Firm*—Posz Law Group, PLC

(57) ABSTRACT

Disclosed is an improved low alloy high speed tool steel, which exhibits constant toughness with small dispersion of the properties after heat treatment and regardless of the size of the products. The steel consists essentially of, by weight %, C: 0.50-0.75%, Si: 0.02-2.00%, Mn: 0.1-3.0%, P: up to 0.050%, S: up to 0.010%, Cr: 5.0-6.0%, W: 0.5-2.0%, V: 0.70-1.25%, Al: up to 0.1%, O: up to 0.01% and N: up to 0.04% and the balance of Fe. In the steel [Mo+0.5W](Mo-eq.) is 2.5-5.0%, [Mo-eq.]/V is 2-4. In the annealed state the steel contains carbides of the types of MC+$M_6C$ and/or $M_{23}C_6$ ($M_7C_3$), and after quenching from a temperature of 1100-1200° C. it contains substantially no remaining carbide or, even contains, almost all the carbides are of MC.

10 Claims, 2 Drawing Sheets

Control Example A

Working Example 2

LOW ALLOY HIGH STEEL TOOL HAVING CONSTANT TOUGHNESS

CROSS REFERENCE TO RELATED APPLICATION

This application is a continuation-in-part application of U.S. Ser. No. 10/806,440 filed Mar. 23, 2004, now abandoned, which is incorporated herein by reference.

BACKGROUND OF THE INVENTION

1. Field in the Industry

The present invention concerns high speed tool steel called "matrix type high speed steel". The invention provides the steel of this kind, in which dispersion of the properties after heat treatment is small and high toughness can be always obtained.

2. Prior Art

It is often practiced that forging dies and press forming dies used in hot working and metal working dies and roll forming dies used in cold working are made with matrix type high speed steel which is a die material of high strength. Examples of the matrix type high speed steels are M50, M52 and so on, which are standardized in AISI. In Japan it has been proposed to use a high speed steel such as SKH51 as the basic alloy and lower the contents of carbon, molybdenum and tungsten therein so as to decrease the quantity of carbides formed therein and to improve the toughness (Japanese Patent Publications No. S50-10808 and Japanese Patent Disclosure No. S61-213349).

However, in case where the above-mentioned known materials are used for dies of cold metal working, it is often observed that very strong strain is locally posed on the dies and therefore, the molds may easily be broken in early stage of use without enjoying full lives. Even in dies for warm forging, working temperature is so controlled to obtain the products having better quality and thus, high load may be posed on the forging dies. Under these circumstances it is the current status that, using the conventional materials, the die lives may not be constant.

The inventor wished to break through the status of technology and sought a solution. He considered at the beginning of his development as follows. First, in order to prevent drastic destroy of the tools used in the state of high hardness and to ensure constant long lives, it is necessary to prevent formation of coarse carbides which may be the starting points of fracture, and therefore, the alloy design should be so made that the possibility of forming coarse carbides may be low. Then he noted that, in the present technology, without controlling the temperature range of quenching in such a narrow range as 10° C. or so, it will be difficult to ensure the hardness of the steel after heat treatment. Such controlling is not easy to realize in practical operation and thus, properties of the product tools have wide dispersion. Solution for this problem is, he considered, to make variation of solid-solution behavior of the carbides small even at various heat treatment temperatures. Further, because hardness and toughness greatly varies by the manner of cooling at quenching (or cooling rates), it is inevitable that the properties of the products vary depending on the sizes of the products. The inventor's conclusion in this regard was to aim at alloy compositions which give constant properties even if the cooling rates vary.

Based on the above-described analysis the inventor chose the following measures:

1) For the purpose of decreasing formation of coarse carbides, in view of the facts that the coarse carbides existing at the time of solidification are those of MC-carbides mainly of VC, it will be effective to decrease the content of vanadium and to hold the steel in sufficient soaking (for example, to keep at a temperature of 1200° C. or higher for 10 hours or more) so as to have the carbides dissolved.

2) In order to lower the sensitivity to heat treatment temperature it is effective to avoid drastic change of carbon solution at ordinary temperature range of quenching (1100° C. to 1200° C.) by making the structure at equilibrium condition γ+MC-phase or γ-single phase. For this, it is essential to appropriately control the Mo- and W-content as the balance of components.

SUMMARY OF THE INVENTION

The object of the present invention is, based on the above-descrlbed inventor's analysis and choice, to provide a high speed tool steel in the category of "matrix type high speed steel", in which dispersion of the metal properties after heat treatment is small and constant high toughness is obtained regardless of the sizes of the products.

The low alloy high speed tool steel achieving the above object according to the present invention, consists essentially of, as the basic alloy composition, by weight %, C: 0.50-0.75%, Si: 0.02-2.00%, Mn: 0.1-3.0%, P: up to 0.050%, S: up to 0.010%, Cr: 5.0-6.0%, W: 0.5-2.0%, V: 0.70-1.25%, Al: up to 0.1%, O: up to 0.01% and N: up to 0.04% and the balance of Fe, provided that [Mo+0.5W] (Mo-equivalent, hereinafter referred to as "Mo-eq.") is 2.5-5.0% and that Mo-eq./V is 2-4, and that it contains carbides of the types of, in the annealed state, MC+$M_6C$ and/or $M_{23}C_6$($M_7C_3$), and after quenching from a temperature of 1100-1200° C., substantially no remaining carbide or, even contained, almost all the carbides are of the type MC.

DETAILED DESCRIPTION OF THE PREFERRED EMBODIMENTS

Figure 1:
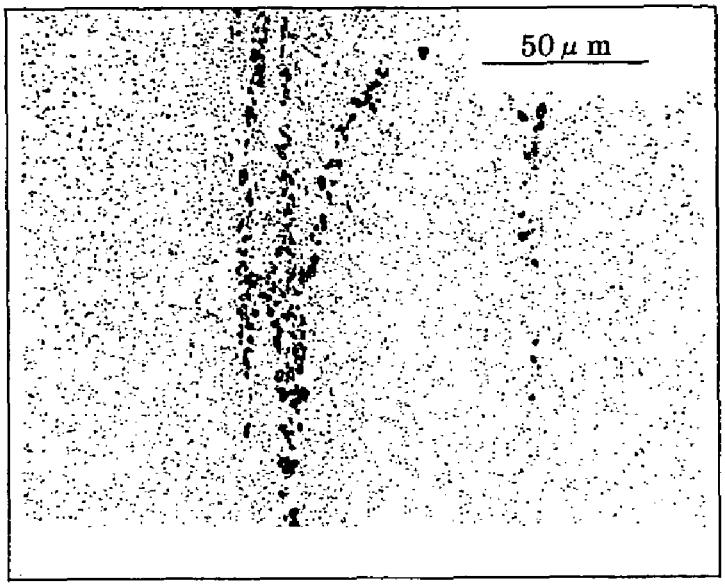
FIG. 1 is a photograph of microstructure of Control Example No. A steel prepared in the Examples described below, which was subjected to selective attack of the carbides.

Comparison of the present steel with the known steel makes it clear that, in the above-mentioned known technologies disclosed in Japanese Patent Publication No. S50-10808 and Japanese Patent Disclosure No. S61-213349, decreasing the contents of C. Mo and W of the conventional high speed steel was made without choosing appropriate content of Cr, and that appropriate choice of Cr-content in the present steel made it possible to heat-treat large tool blanks which could not be heat-treated before. Japanese Patent Disclosure No. H07-316739 discloses controlling the relations between Cr-content and W- and Mo-content with the aim to constant properties after heat treatment in large sized products. However, the alloy composition in this prior art is in a higher alloy side when compared with the present invention.

Improvement of carbide distribution by soaking the matrix type high speed steels has been proposed (Japanese Patent Disclosure No. H04-346616). However, in case where addition amounts of alloy components are large, it will be difficult to make the carbides which are coarse primary crystal carbides dissolved in the matrix even if soaking is done, and therefore, selection of the alloy composition is important. The present invention succeeded in suppressing changes of the properties on the changes of quenching temperature by choosing alloy compositions with which substantially no changes occur in carbides during quenching from an ordinary quenching temperature (1100-1200° C.).

In the low alloy high speed tool steel of the present invention Si-content is preferably in the range of 0.2-0.8%.

The low alloy high speed tool steel of the invention may contain, in addition to the above-described basic alloy elements, further alloy element or elements enumerated below solely or in combination:

I) one or more of Ni: up to 2.0%, Cu: up to 1.0% and Co: up to 3.0%;

II) B: up to 0.01%; and

III) Nb: up to 0.1%, in this case Mo-eq./(V+5Nb) must be in the range of 2-4.

The following explains the reasons for selecting the alloy compositions as defined above on both the essential elements and the optional elements in this order.

C: 0.50-0.75%

Carbon is an important component which gives hardness and wear resistance to the tools. In order to obtain the lowest strength required to the material of tools for cold forging or tools for hot forging it is necessary to add at least 0.50% of carbon. Excess addition of C will cause formation of coarse carbide particles and as the results, toughness of the tools will become low. Thus, addition amount should not exceed 0.75%.

Si: 0.02-2.00%, preferably 0.20-0.80%

Silicon is necessary as a deoxidizing agent of steel and is also useful as an element for increasing softening resistance by tempering. However, too much Si significantly lowers the machinability and causes lowered toughness by promoting segregation. Due to these reasons the lower limit is of Si set to 0.02% and the upper limit, 2.00%. Preferable range is 0.20-0.80%.

Mn: 0.1-3.0%

Manganese is necessary for ensuring hardenability and hardness of the alloy, and for preventing decrease of hot workability caused by sulfur inevitably contained in this tool steel. To obtain these effects addition of Mn in an amount of 0.1% or more is required. Addition of a large amount of Mn results in lowered workability and the upper limit, 3.0%, is thus set.

Cr: 5.0-6.0%

Chromium mainly forms Cr-carbide under the annealed condition, which dissolves in the matrix during quenching. Because sufficient hardenability cannot be assured with too small amount of addition, the lower limit of Cr, 5.0%, is set. On the other hand, too much addition brings about remaining Cr-base carbide, which affects stability of hardness after heat treatment. The upper limit of Cr thus decided is 6.0%. In the present invention selection of the Cr-content at the narrow range of 5.0-6.0% makes it possible not only to ensure the hardenability but also to have almost all the Cr-carbide dissolved in the matrix under the ordinary quenching condition (1100-1200° C.).

V: 0.70-1.25%

Vanadium forms an MC carbide, which remains in the tool steel at the time of quenching to strengthen the matrix and improves wear resistance. Unless the addition amount is 0.70% or more the merit cannot be sufficiently obtained. If, however, the addition amount is too much, not all the stable MC carbide dissolves in the matrix but a large part remains therein, and the remained carbide damages the toughness of the steel. The upper limit of V is, therefore, set to 1.25%.

W: 0.5-2.0%, and [Mo+0.5W] (Mo-eq.): 2.5-5.0

Both molybdenum and tungsten precipitate as fine carbides at the time of quench-and-temper and the carbides exist in the matrix with the effect of increasing the high temperature strength of the tool. For this increase of the high temperature strength it is necessary to add Mo and W in an amount of, as the Mo-eq. expressed by the formula Mo+0.5W, 2.5% or more. Too much addition causes formation of coarse carbides in the matrix and decrease of the toughness. Thus, 5% as the Mo-eq. is the upper limit of W-content. When W and Mo are compared, W gives much more contribution than Mo to the high temperature strength by dissolving in the matrix, and hence, addition of a small amount of W brings about larger effect. This is the reason why the least amount of W-addition is set to 0.5%. W forms, however, $M_6C$ carbide which is more stable than that of Mo. If a large amount of W is added the carbide will not fully dissolve in the matrix at the quenching temperature. Thus, the upper limit of W-addition, 2.0%, is set as the limit for sufficient solid solution of the carbide.

P: up to 0.50%, S: up to 0.010%

Phosphor is an element lowering the toughness and heat-check property of the steel. Though it is preferable to decrease the content as low as possible, a certain amount of P will be inevitably contained in the steel. Up to 0.050% of P is allowable, and 0.010% or less is preferable. Sulfur is also an element lowering the toughness and the heat-check property, and therefore, a smaller content is preferable. However, a certain amount of S is inevitable. The allowable limit is 0.010%.

Al: up to 0.1%

Aluminum is used as a deoxidizing agent at preparation of this kind of steel. When a large amount of Al is added, it remains in the steel in the form of oxide ($Al_2O_3$-base) inclusions and significantly decreases the toughness. Therefore, the upper limit is set to 0.1%.

O: up to 0.01%

Oxygen inevitably comes from the melting atmosphere at steel making and dissolves in the molten steel. If too much amount is contained, oxides such as those combined with Si and Al are formed and as the result, the toughness of the steel will become very low. The upper limit of O, 0.01%, is thus set.

N: up to 0.04%

Nitrogen also inevitably dissolves in the molten steel to form nitrides by combining with V in the steel. In case where a large amount of N is contained coarse nitrides will be formed and decreases the toughness of the steel. As the upper limit, 0.04% is set.

Mo-eq./V: 2-4

With the requisites of the alloy compositions defined above, regulation of Mo-eq./V to 2-4 makes it possible to obtain a high speed tool steel having constant properties (hardness and toughness) after heat treatment by changing the system from that containing the carbides of the types of $MC+M_6C+M_{23}C_6(M_7C_3)$ as annealed to that containing substantially no carbide or, even if contained, almost all the carbide is of the type MC after quenching (1100-1200° C.). One or more of Ni: up to 2.0%, Cu: up to 1.0% and Co: up to 3.0%

The effect common in nickel, copper and cobalt is strengthening of the matrix. In addition to this, Ni contributes to improvement of hardenability. Too much addition results in, as to Ni and Co, decrease of the workability, and as to Cu, decrease of the toughness. It is recommended to choose suitable amount or amounts of addition in the limits of, up to 2.0% for Ni, up to 1.0% for Cu and up to 3.0% for Co.

B: up to 0.01%

Boron is useful for improving hardenability of the steel, and it is recommended to add B upon necessity. Excess addition of B causes formation of inclusions by combination with N. Thus, the upper limit is set to 0.01%.

Nb: up to 0.1%

Because niobium is an element forming an MC carbide, which is more stable than the carbide of V, a part of V can be replaced with Nb. Due to the higher stability of Nb-carbide, coarse carbides resulted from addition of a large amount of Nb do not disappear and damage the toughness. Therefore, addition amount of Nb is limited to 0.1%. In case where Nb is added the above formula of "Mo-eq./V" should read "Mo-eq./(V+5Nb)".

The low alloy high speed tool steel according to the invention is based on choosing particular low alloy composition and by arranging the system so that it may contain, in the state of annealed, the carbides of the types $MC+M_6C+M_{23}C_6$ ($M_7C_3$) and, after quenching at 1100-1200° C., substantially no carbide. Even if contained, almost all the carbide is of the type MC. The invention has the following merits:

1) that variation of the solution behavior of the carbides depending on the variation of the heat treatment temperature is modest, and therefore, that it is possible to ensure the hardness of the steel after the heat treatment even if the quenching temperature is not controlled in a narrow range; and 2) that constant quenching properties can be obtained even if the cooling rates varies depending on the manner of cooling at quenching, and as the results, the hardness and the toughness of the product steel may not vary so much. This leads to the merits of little dispersion of quenching properties depending on the sizes of the product tools and stable high toughness.

As explained above, the present invention provides high speed tool steel products having constant toughness in the category of "matrix type high speed steel".

EXAMPLES

The Invented Steels and the Control Steels of the alloy compositions shown in Table 1 were prepared in a vacuum induction furnace of capacity 150 kg. The Control Steels are high hardness matrix type high speed steels conventionally used and high speed tool steels (JIS-SKH51). The steels cast into ingots were soaked (at 1230° C. for 10 hours or longer) and forged. The forged materials, which were hot worked to forging ratio 8S, were subjected to determination of the following properties.

The results are shown in Table 2.

[States of the Remaining Carbides]

Figure 2:
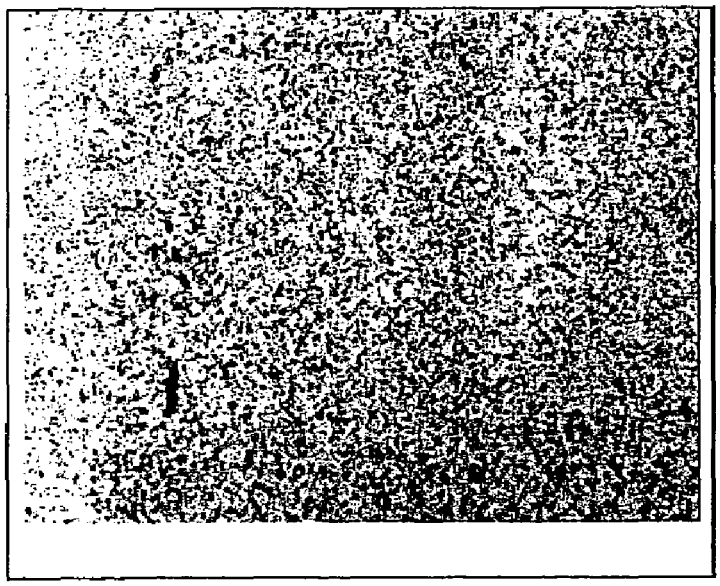
FIG. 2 is a microscopic photograph of Working Example No. 2 steel prepared in the Examples described below, which was subjected to selective corrosion of the carbides.

Control steel No. A and Invented Steel No. 2 were chosen and subjected microstructure observation after selective attack of MC carbides and $M_2C$ carbides by $Cr_2O_3$-electrolysis corrosion. FIG. 1 shows the micro structure of Control Steel No. A, and FIG. 2, that of Invented Steel No. 2. It is observed that in FIG. 1 a large quantity of coarse carbides remain, while in FIG. 2, quantity of the coarse carbide particles is small and instead, fine carbide particles are dispersed.

[Hardness After Heat Treatment]

There has been known the problem that, if the types of the remaining carbides tend to alter, for example, $MC+M_6C$ to MC single phase, amounts of the carbides dissolved in the steel varies even by small difference of the quenching temperature, and it Is impossible to obtain constant hardness and toughness. On this basis, stability of the hardness after heat treatment was surveyed by comparing the types of the remaining carbides after quenching at 1100° C. and 1200° C., which are considered to be the lower and the upper limits of ordinary quenching operation.

The results are as shown in Table 2. The Invented Steel contained only MC carbide by quenching from 1100° C., and almost all the carbide disappeared by quenching from 1200° C. The Control Steel contained $MC+M_6C$ carbides by quenching from 1100° C., and in the cases of quenching from 1200° C., the changes were divergent: some steels contained MC carbide, or no carbide, and the other showed the change similar to that of the Invented Steels.

[Hardness After Heat Treatment Depending on the Cooling Rates in the Heat Treatment]

In order to inspect whether constant properties can be obtained even if the cooling rates varies, two ways of quenching, Oil-Quenching (in Table 2 abbreviated as "O.Q.") and Controlled Quenching (the cooling rate of 30° C./min., abbreviated as "C.Q.") were chosen, and the hardness value resulting from the difference in the cooling were compared.

Table 2 shows, together with the temperatures of quench-and-temper, the hardness by O. Q. and C. Q. To clearly show the differences of hardness after heat treatment depending on the ways of cooling the differences of the hardness are shown in the rightmost column of Table 2. Decrease of the hardness is, in HRC, 0.5 point or less in the Invented Steels. On the other hand, in some of the Control Steels, decrease of 1 point or more is observed and thus, it is concluded that the hardness after heat treatment is not constant.

[Ensuring the Constant Toughness in Regard to the Heat Treatment and the Structure]

Figure 3:
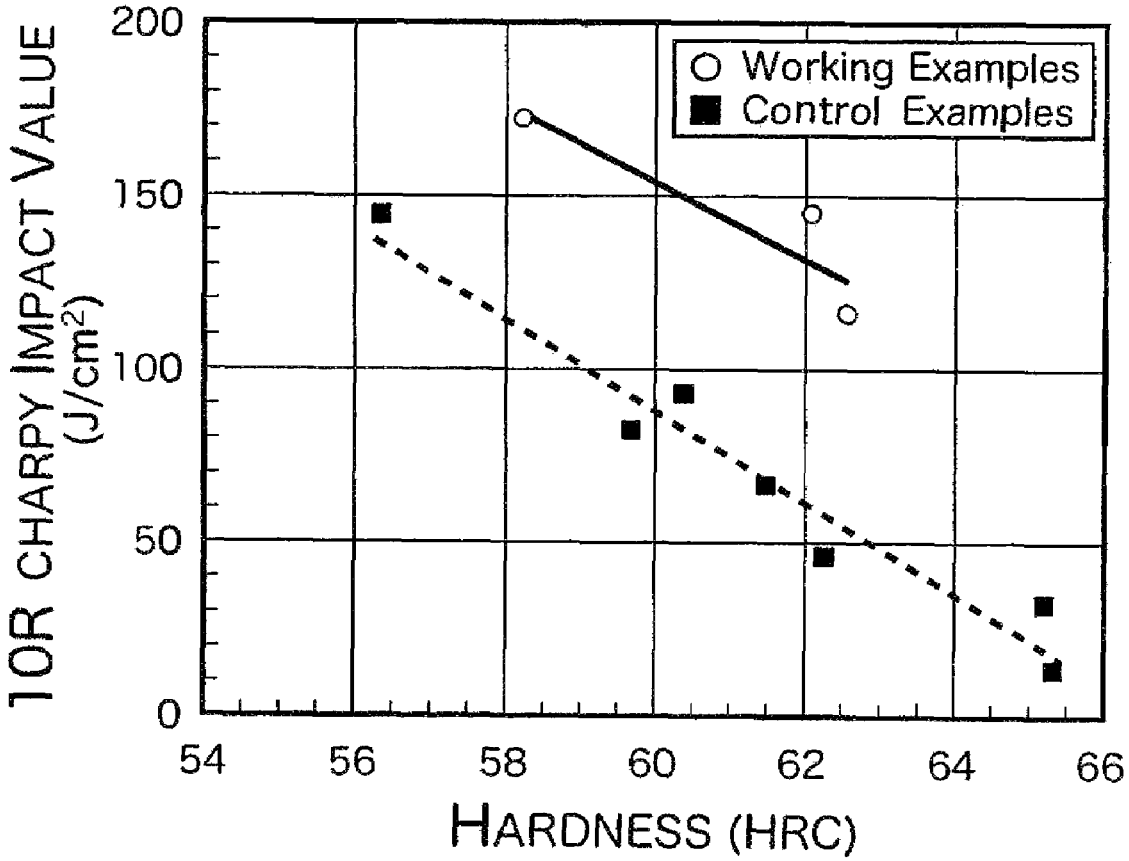
FIG. 3 is a graph showing the data of the Example of this invention prepared by plotting the relation between the values of the hardness and the Charpy Impact Value.

With respect to each of the steels test pieces were prepared by heat treatment of the quenching temperatures and tempering temperatures shown in Table 2. They were subjected to 10R-Charpy impact tests with n=3 (three samples), and the obtained values were averaged to determine the measures of the toughness. The steel had a 10R-Charpy impact valued equal to or greater than about 120 J/cm$^2$, and a hardness (HRC) equal to or greater than about 58. The relationship between the hardness after the heat treatment and the toughness was surveyed and compared with that of the conventional steels. The results are shown in the graph of FIG. 3. From this graph it is clearly understood that the toughness of the Invented Steels is generally higher than that of the Control Steels.

TABLE 1

| No. | C | Si | Mn | P | S | Cu | Ni | Co | Cr | Mo | W | V | Nb | Al | O | N | B |
|---|---|---|---|---|---|---|---|---|---|---|---|---|---|---|---|---|---|
| Alloy Composition (Working Examples) | | | | | | | | | | | | | | | | | |
| 1 | 0.72 | 1.12 | 0.63 | 0.014 | 0.007 | 0.012 | 0.56 | 1.53 | 5.78 | 2.54 | 1.53 | 1.21 | 0.05 | 0.002 | 0.012 | 0.0195 | — |
| 2 | 0.65 | 0.25 | 0.50 | 0.008 | 0.002 | — | 0.14 | 0.14 | 5.45 | 2.37 | 0.99 | 0.99 | 0.01 | 0.012 | 0.001 | 0.0039 | 0.005 |
| 3 | 0.54 | 0.14 | 0.31 | 0.021 | 0.005 | 0.34 | — | — | 5.14 | 1.85 | 0.61 | 1.05 | — | 0.006 | 0.008 | 0.0089 | — |
| 4 | 0.63 | 0.11 | 0.44 | 0.028 | 0.005 | — | 0.13 | — | 5.01 | 2.15 | 1.37 | 1.18 | — | 0.026 | 0.010 | 0.008 | — |
| 5 | 0.52 | 0.85 | 0.14 | 0.031 | 0.001 | — | 0.30 | 1.42 | 5.37 | 4.11 | 1.65 | 1.24 | 0.09 | 0.027 | 0.008 | 0.026 | — |
| 6 | 0.56 | 0.22 | 0.29 | 0.045 | 0.001 | 0.69 | 0.68 | 0.21 | 5.92 | 2.85 | 1.64 | 0.92 | 0.04 | 0.072 | 0.004 | 0.039 | 0.008 |
| 7 | 0.67 | 1.06 | 0.60 | 0.047 | 0.003 | 0.23 | — | — | 5.30 | 3.55 | 0.50 | 1.20 | — | 0.045 | 0.010 | 0.034 | — |
| 8 | 0.54 | 0.11 | 2.01 | 0.047 | 0.008 | 0.83 | 0.21 | 0.51 | 5.19 | 3.24 | 1.24 | 1.09 | — | 0.098 | 0.006 | 0.002 | — |
| 9 | 0.61 | 1.44 | 0.82 | 0.047 | 0.002 | — | — | — | 5.12 | 2.55 | 0.87 | 0.75 | — | 0.027 | 0.006 | 0.004 | — |
| 10 | 0.57 | 1.68 | 0.96 | 0.033 | 0.004 | 0.78 | 1.17 | 1.84 | 5.14 | 2.24 | 1.89 | 1.08 | — | 0.092 | 0.003 | 0.027 | — |
| 11 | 0.56 | 1.65 | 0.19 | 0.039 | 0.008 | 0.74 | — | 0.99 | 5.72 | 2.45 | 1.10 | 1.23 | — | 0.088 | 0.004 | 0.013 | 0.004 |
| 12 | 0.67 | 1.38 | 0.57 | 0.047 | 0.001 | — | 0.57 | 0.61 | 5.42 | 3.04 | 1.30 | 1.09 | — | 0.017 | 0.006 | 0.008 | — |
| 13 | 0.56 | 0.53 | 0.53 | 0.014 | 0.006 | — | — | — | 5.37 | 2.04 | 1.01 | 0.81 | — | 0.010 | 0.005 | 0.039 | — |
| 14 | 0.74 | 0.74 | 1.55 | 0.032 | 0.002 | — | 0.47 | 0.47 | 5.31 | 3.09 | 1.27 | 1.08 | — | 0.062 | 0.001 | 0.023 | — |
| 15 | 0.61 | 0.52 | 0.50 | 0.032 | 0.003 | 0.65 | — | 1.40 | 5.47 | 3.52 | 0.66 | 1.14 | — | 0.018 | 0.002 | 0.007 | — |
| 16 | 0.71 | 1.28 | 0.15 | 0.031 | 0.010 | 0.84 | 0.92 | — | 5.32 | 2.45 | 1.16 | 1.24 | — | 0.044 | 0.007 | 0.001 | 0.003 |
| Alloy Composition (Control Examples) | | | | | | | | | | | | | | | | | |
| A | 0.52 | 0.11 | 0.54 | 0.002 | 0.001 | 0.13 | — | 0.99 | 4.22 | 2.03 | 1.55 | 1.19 | 0.09 | 0.005 | 0.012 | 0.0135 | — |
| B | 0.65 | 1.46 | 0.95 | 0.002 | 0.001 | — | 0.53 | — | 4.23 | 2.81 | — | 1.80 | — | 0.021 | 0.001 | 0.0067 | 0.015 |
| C | 0.80 | 0.85 | 1.33 | 0.002 | 0.001 | — | — | — | 4.99 | 5.45 | 1.19 | 1.19 | — | 0.004 | 0.008 | 0.0051 | — |
| D | 0.51 | 0.34 | 0.30 | 0.001 | 0.001 | — | 0.21 | — | 4.92 | 3.74 | 1.49 | 0.99 | 0.05 | 0.005 | 0.010 | 0.0112 | 0.008 |
| E | 0.81 | 0.80 | 0.25 | 0.004 | 0.002 | 0.32 | 0.11 | — | 5.47 | 5.03 | 1.01 | 1.20 | 0.01 | 0.015 | 0.008 | 0.0081 | — |
| F | 0.56 | 0.07 | 0.34 | 0.006 | 0.001 | 0.24 | — | — | 5.57 | 3.75 | 1.51 | 1.09 | — | 0.009 | 0.004 | 0.0037 | — |
| G | 0.88 | 0.40 | 0.45 | 0.012 | 0.004 | 0.11 | — | 0.12 | 3.97 | 5.11 | 6.01 | 1.79 | — | 0.002 | 0.010 | 0.0238 | — |

TABLE 2

| | Remaining Carbides Soaked at | | Quench and Temper | Charpy Impact Value | Hardness (HRC) | | Hardness Decrease |
|---|---|---|---|---|---|---|---|
| No. | 1100° C. | 1200° C. | Temp. (° C.) | (J/cm$^2$) | O.Q. | C.Q. | (HRC) |
| Test Results (Working Examples) | | | | | | | |
| 1 | MC | none | 1140 + 560 | 145 | 62.1 | 61.9 | 0.2 |
| 2 | MC | none | 1140 + 560 | 117 | 62.6 | 62.5 | 0.1 |
| 3 | MC | none | 1140 + 560 | 173 | 58.3 | 57.9 | 0.4 |
| 4 | MC | none | 1160 + 570 | 128 | 61.8 | 61.5 | 0.3 |
| 5 | MC | small amount of MC | 1160 + 560 | 245 | 56.2 | 55.8 | 0.4 |
| 6 | MC | none | 1140 + 540 | 220 | 59.1 | 59.0 | 0.1 |
| 7 | MC | none | 1160 + 580 | 145 | 62.5 | 62.0 | 0.5 |
| 8 | MC | none | 1140 + 580 | 208 | 56.7 | 56.2 | 0.5 |
| 9 | MC | none | 1120 + 540 | 159 | 61.2 | 60.8 | 0.4 |
| 10 | MC | none | 1140 + 560 | 172 | 60.0 | 59.7 | 0.3 |
| 11 | MC | none | 1140 + 560 | 213 | 56.2 | 55.8 | 0.4 |
| 12 | MC | none | 1140 + 580 | 132 | 63.7 | 63.6 | 0.1 |
| 13 | MC | none | 1160 + 560 | 201 | 57.3 | 56.9 | 0.4 |
| 14 | MC | none | 1180 + 570 | 128 | 64.1 | 64.0 | 0.1 |
| 15 | MC | none | 1160 + 560 | 159 | 61.2 | 61.1 | 0.1 |
| 16 | MC | small amount of MC | 1180 + 570 | 130 | 63.9 | 63.9 | 0.0 |
| Test Results (Control Examples) | | | | | | | |
| A | MC | none | 1140 + 540 | 145 | 56.4 | 53.8 | 2.6 |
| B | MC | MC | 1160 + 560 | 46 | 62.3 | 59.8 | 2.5 |
| C | MC + $M_6C$ | MC + $M_6C$ | 1160 + 580 | 33 | 65.2 | 64.2 | 1.0 |
| D | MC + $M_6C$ | none | 1140 + 540 | 67.3 | 61.5 | 59.4 | 2.1 |
| E | MC + $M_6C$ | MC | 1150 + 560 | 83 | 59.7 | 59.6 | 0.1 |
| F | MC + $M_6C$ | none | 1140 + 540 | 94 | 60.4 | 60.0 | 0.2 |
| G | MC + $M_6C$ | MC + $M_6C$ | 1200 + 560 | 14 | 65.3 | 62.2 | 3.1 |

The invention claimed is:

1. A low alloy high speed tool steel, which consists essentially of, by weight %, C: 0.50-0.75%, Si: 0.02-2.00%, Mn: 0.1-3.0%, P: up to 0.050%, S: up to 0.010%, Cr: 5.0-6.0%, W: 0.5-2.0%, V: 0.70-1.25%, Al: up to 0.1%, O: up to 0.01% and N: up to 0.04%, Mo in an amount satisfying the relationship [Mo+0.5W](Mo-eq.) is 2.5-5.0%, and the balance of Fe, wherein Mo-eq./V is 2-4, the steel contains carbides of, in the annealed state, [MC+$M_6C$] and/or $M_{23}C_6(M_7C_3)$; and after quenching from a temperature of 1100-1200° C., the steel contains one of substantially no remaining carbide and remaining carbides of MC, the steel has a 10R Charpy impact value equal to or greater than about 120 J/$cm^2$, the steel has a hardness (HRC) equal to or greater than about 58, and a difference between hardness by oil quenching and hardness by controlled quenching of the steel is less than or equal to 0.5.

2. A low alloy high speed tool steel, which consists essentially of, by weight %, C: 0.50-0.75%, Si: 0.02-2.00%, Mn: 0.1-3.0%, P: up to 0.050%, S: up to 0.010%, Cr: 5.0-6.0%, W: 0.5-2.0%, V: 0.70-1.25%, Al: up to 0.1%, O: up to 0.01% and N: up to 0.04%, Mo in an amount satisfying the relationship [Mo+0.5W](Mo-eq.) is 2.5-5.0%, and the balance of Fe, wherein Mo-eq./V is 2-4, the steel contains carbides of, in the annealed state, [MC+$M_6C$] and/or $M_{23}C_6(M_7C_3)$; and after quenching from a temperature of 1100-1200° C., the steel contains one of substantially no remaining carbide and remaining carbides of MC, the steel has a 10R Charpy impact value in the range of 117 to 245 J/$cm^2$, and the steel has a hardness (HRC) in the range of 57.9 to 64.0, and a difference between hardness by oil quenching and hardness by controlled quenching of the steel is less than or equal to 0.5.

3. The low alloy high speed tool steel according to claim 1, wherein Si-content is 0.2-0.8%.

4. The low alloy high speed tool steel according to claim 1, wherein the steel further contains at least one of the group consisting of Ni: up to 2.0%, Cu: up to 1.0% and Co: up to 3.0%.

5. The low alloy high speed tool steel according to claim 1, wherein the steel further contains B: up to 0.01%.

6. The low alloy high speed tool steel according to claim 1, wherein the steel further contains Nb: up to 0.1%, and wherein Mo-eq./(V+5Nb) is 2-4.

7. The low alloy high speed tool steel according to claim 1, wherein the steel further contains at least one of the group consisting of Ni: up to 2.0%, Cu: up to 1.0% and Co: up to 3.0%, and B: up to 0.01%.

8. The low alloy high speed tool steel according to claim 1, wherein the steel further contains at least one of the group consisting of Ni: up to 2.0%, Cu: up to 1.0% and Co: up to 3.0%, and Nb: up to 0.1%, and wherein Mo-eq./(V+5Nb) is 2-4.

9. The low alloy high speed tool steel according to claim 1, wherein the steel further contains B: up to 0.01% and Nb: up to 0.1%, and wherein MO-eq./(V+5Nb) is 2-4.

10. The low alloy high speed tool steel according to claim 1, wherein the steel further contains at least one of the group consisting of Ni: up to 2.0%, Cu: up to 1.0% and Co: up to 3.0%, B: up to 0.01% and Nb: up to 0.1%, and wherein Mo-eq./(V+5Nb) is 2-4.

* * * * *